US011111760B2

(12) United States Patent
Larsen et al.

(10) Patent No.: US 11,111,760 B2
(45) Date of Patent: Sep. 7, 2021

(54) VECTORED ANNULAR WELLBORE CLEANING SYSTEM

(71) Applicants: Adam Larsen, Houston, TX (US); Joeri Van Hove, Castricum (NL)

(72) Inventors: Adam Larsen, Houston, TX (US); Joeri Van Hove, Castricum (NL)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 49 days.

(21) Appl. No.: 16/697,705

(22) Filed: Nov. 27, 2019

(65) Prior Publication Data

US 2021/0156228 A1 May 27, 2021

(51) Int. Cl.
*E21B 37/04* (2006.01)

(52) U.S. Cl.
CPC ..... *E21B 37/04* (2013.01)

(58) Field of Classification Search
CPC ..... E21B 37/00; E21B 37/02; E21B 37/04; E21B 37/045
See application file for complete search history.

(56) References Cited

U.S. PATENT DOCUMENTS 2,771,141 A * 11/1956 Farral ..... E21B 37/00 166/222
4,991,653 A * 2/1991 Schwegman ..... E21B 23/006 166/191
2003/0145990 A1* 8/2003 Longacre ..... E21B 37/00 166/265
2017/0314364 A1* 11/2017 Getzlaf ..... E21B 23/01

OTHER PUBLICATIONS

Schlumberger Oilfield Glossary—Snubbing https://www.glossary.oilfield.slb.eom/en/terms/s/snubbing accessed 2021 (Year: 2021).*

* cited by examiner

*Primary Examiner* — David Carroll
(74) *Attorney, Agent, or Firm* — Cantor Colburn LLP

(57) ABSTRACT

A vectored annular cleaning system (VACS) includes a tool body having a first end, a second end, an outer surface and an inner surface defining an internal bore. A valve system is arranged in the internal bore. The valve system includes a valve and an actuator member including a central passage. The actuator member extends from the valve toward the second end. A valve actuator is shiftably connected to the tool body and mechanically connected to the actuator member. The valve actuator includes a plurality of drag blocks and one or more spring members. The one or more spring members radially outwardly bias the plurality of drag blocks.

19 Claims, 13 Drawing Sheets

VECTORED ANNULAR WELLBORE CLEANING SYSTEM

BACKGROUND

In the resource recovery industry, it is often desirable to perform a wellbore clean out operation. Clean out may be accomplished through the introduction of a tool string including a clean out tool that directs jets of fluid downwardly. The jets of fluid may pass about a terminal end of the tool into the wellbore. The jets of fluid force debris in the wellbore into the tool. The debris may be captured in a holding chamber and carried out of the wellbore for disposal.

During run-in and run-out of the tool string, the holding chamber is exposed to wellbore pressure. Exposure to pressure during run-out can create a number of challenges including increasing a weight of the tool string. As the holding chamber could be 4,000 feet or longer, increasing weight of the holding chamber could add challenges to run-out including the need for more robust equipment for lifting the tool string from the well bore.

SUMMARY

Disclosed is a vectored annular cleaning system (VACS) including a tool body having a first end, a second end, an outer surface and an inner surface defining an internal bore. A valve system is arranged in the internal bore. The valve system includes a valve and an actuator member including a central passage. The actuator member extends from the valve toward the second end. A valve actuator is shiftably connected to the tool body and mechanically connected to the actuator member. The valve actuator includes a plurality of drag blocks and one or more spring members. The one or more spring members radially outwardly bias the plurality of drag blocks.

Also discloses is a method of removing debris from a wellbore with a vectored annular clean out system (VACS) having a snubber valve including introducing the VACS into the wellbore, creating an axially directed uphole force on the snubber valve, opening the snubber valve with the axially directed uphole force, performing a VACS operation, and picking up the VACS allowing the snubber valve to shift to a closed position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
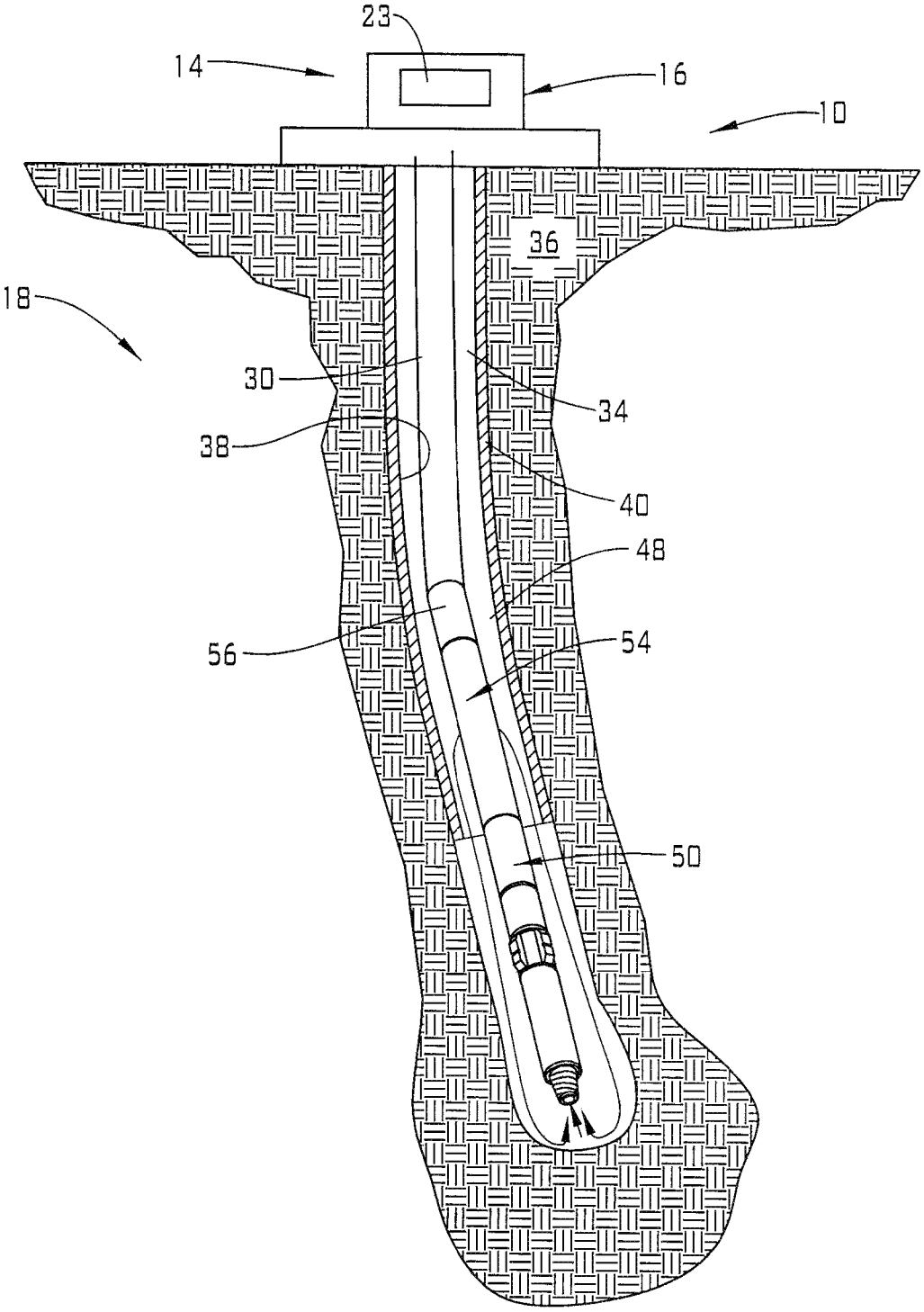
FIG. 1 depicts a resource exploration and recovery system including a vectored annular cleanout system (VACS), in accordance with an exemplary embodiment.
Figure 2:
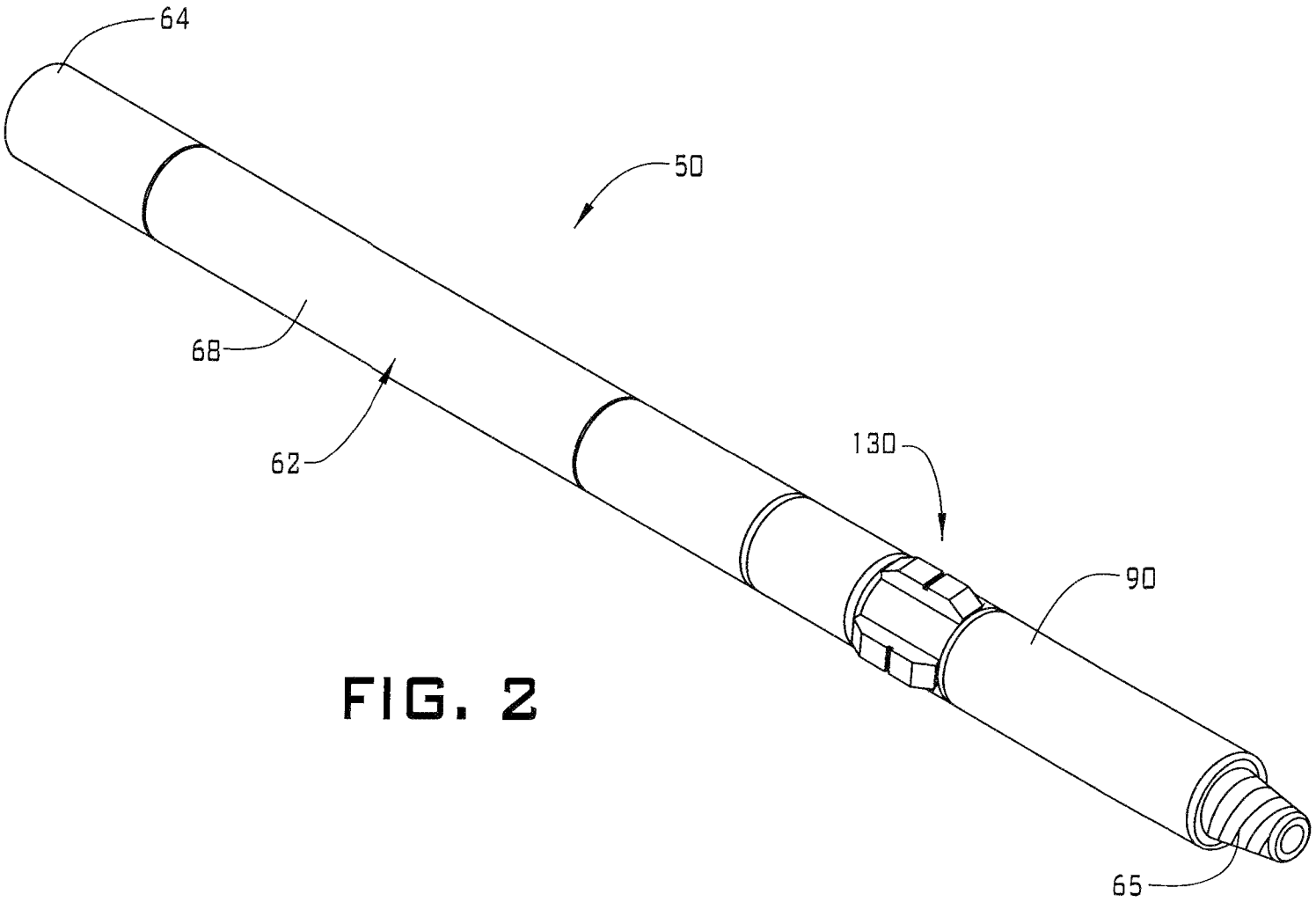
FIG. 2 depicts a snubber valve assembly of the VACS depicted in FIG. 1.
Figure 3:
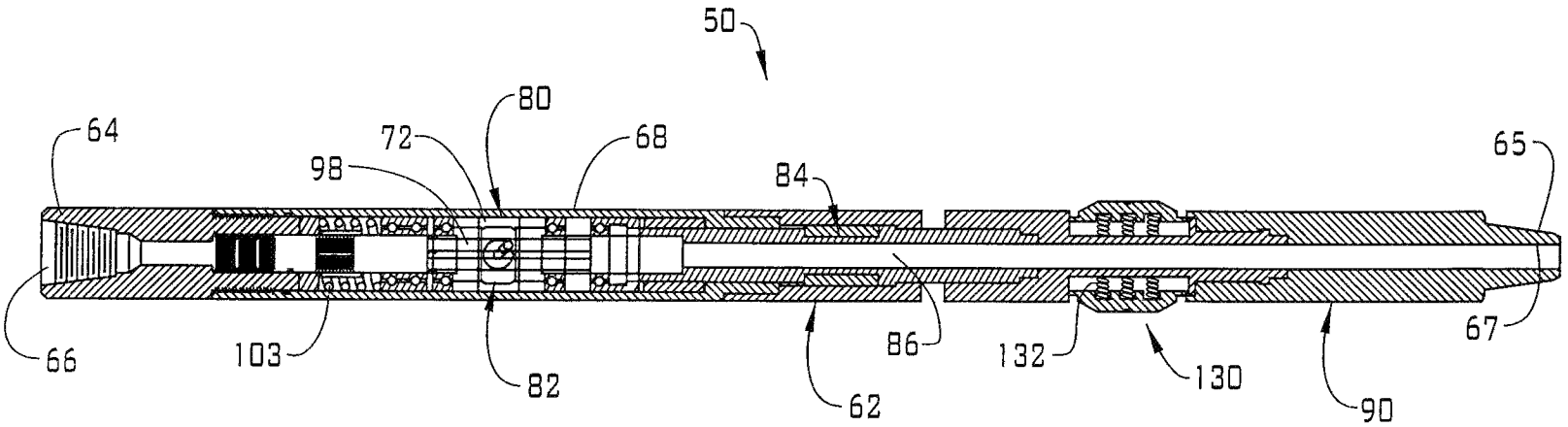
FIG. 3 depicts a cross sectional side view of the snubber valve of FIG. 2, in accordance with an aspect of an exemplary embodiment.

A resource exploration and recovery system, in accordance with an exemplary embodiment, is indicated generally at 10, in FIGS. 1 and 2. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Tubular string 30 may take the form of a plurality of interconnected tubulars, coil tubing, or the like. Wellbore 34 includes an annular wall 38 which may be defined by a casing tubular 40. Of course, annular wall 38 could be defined by a surface of formation 36.

In accordance with an exemplary embodiment, tubular string 30 supports a vectored annular cleaning system (VACS) 48 including a snubbing valve 50, a jet portion 54, and a fluid loss valve 56 which, as will be detailed herein, may maintain a volume of fluid in tubular string 30 between VACS 48 and surface system 16. VACS 48 selectively delivers a flow of fluid into wellbore 34 causing a disturbance that directs debris into snubbing vale 50. The fluid and debris may pass through snubbing valve 50 into a holding chamber (not shown). The fluid and debris may flow directly into snubbing valve 50 or enter through another member and before entering snubbing valve 50.

Figure 4:
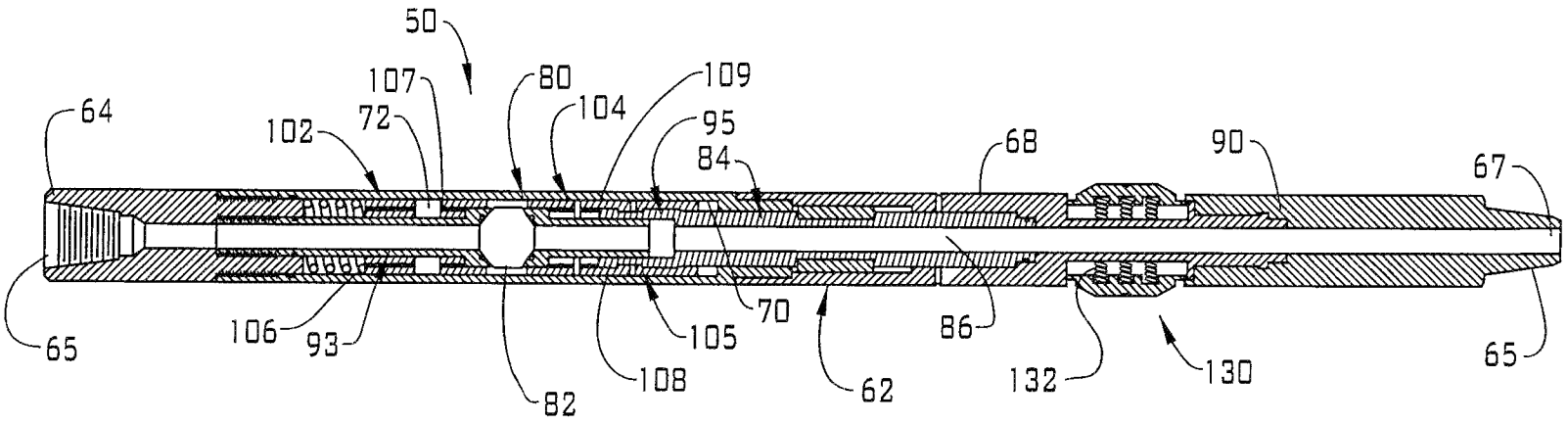
FIG. 4 depicts the cross sectional side view of the snubber valve of FIG. 3 rotated 90 degrees, in accordance with an aspect of an exemplary embodiment.

Referencing FIGS. 2-5, snubbing valve 50 includes a tool body 62 having a first or box end 64 and a second or pin end 65. Box end 64 includes a plurality of internal threads (not separately labeled) and pin end 65 includes a plurality of external threads (also not separately labeled). Box end 64 defines an outlet 66 and pin end 65 defines an inlet 67. Tool body 62 also includes an outer surface 68 and an inner surface 70 (FIG. 4) that defines an internal bore 72. A valve system 80 is arranged in internal bore 72. Valve system 80 includes a valve 82 and an actuator member 84 having a central passage 86. Central passage 86 fluidically connects inlet and outlet. A valve actuator 90 is connected to actuator member 84. Valve actuator 90 operates to shift valve 82 between a closed configuration (FIG. 3) and an open configuration (FIG. 4).

In accordance with an exemplary embodiment, actuator member 84 includes a first portion 93 extending from valve 82 toward outlet 66 and a second portion 95 extending from valve 82 toward inlet 67. A linking member 98 extends across valve 82 and connects first portion 93 with second portion 95. Tool body 62 includes a first guide bushing 102 and a second guide bushing 103 arranged between valve 82 and outlet 66, and a third guide bushing 104 and a fourth guide bushing 105 arranged between valve 82 and inlet 67.

First guide bushing 102 takes the form of a first bearing 106, second guide bushing 103 takes the form of a second bearing 107, third guide busing 104 takes the form of a third bearing 108, and fourth guide bushing 105 takes the form of a fourth bearing 109. First and second guide bushings 102 and 103 support first portion 93 of actuator member 94 in internal bore 72 and third and fourth guide bushings 104 and 105 support second portion 95 of actuator member 94. Guide bushings 102 and 103 support rotation and linear translation of first portion 93 and guide bushings 104 and 105 support rotation and linear translation of second portion 95. Valve system 80 also includes a spring 113 arranged between first guide bushing 103 and box end 64. Spring 113 provides a biasing force on first portion 93 urging actuator member 84 toward inlet 67.

Figure 5:
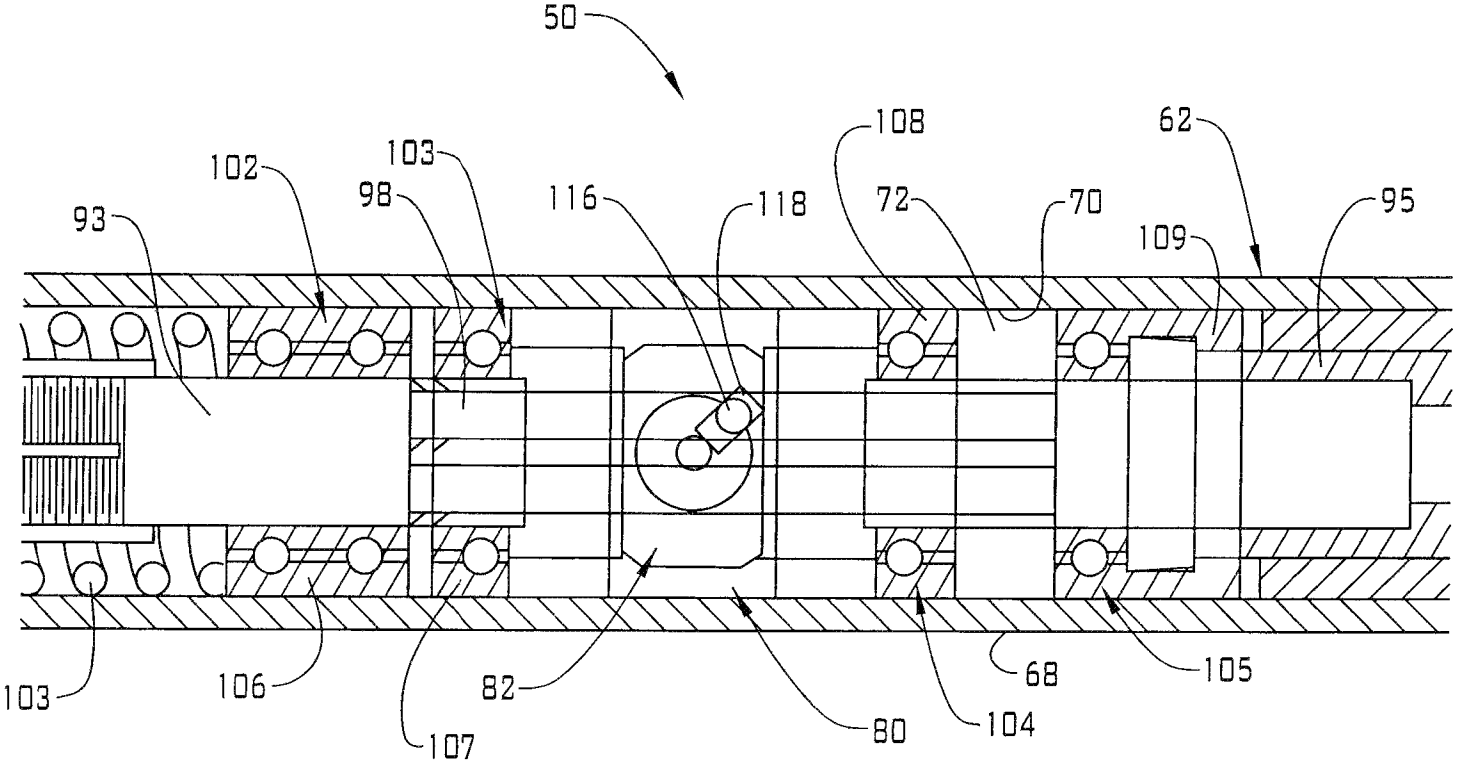
FIG. 5 depicts a detail view of the valve assembly of the snubber valve of FIG. 2, in accordance with an aspect of an exemplary embodiment.

In accordance with an exemplary aspect, linking member 98 includes a pin 116 that extends into a groove 118 in valve 82 as shown in FIG. 5. With this arrangement, linear movement of actuator member 84 translates to rotational movement of valve 82. Thus, application of a force in an uphole direction through valve actuator 90 causes valve 82 to rotated between the closed configuration and the open configuration. Alleviation of the force allows spring 113 to act one actuator member 84 causing valve 82 to translate from the open configuration to the closed configuration. At this point, it should be understood that valve system 79 could be configures such that valve actuator 90 may act on actuator member 84 to close valve 82. It should also be understood that the relative position of pin 116 and groove 118 may be reversed.

In further accordance with an exemplary aspect, valve actuator 90 includes a plurality of drag blocks 130 each of which are radially outwardly biased by a plurality of springs, one of which is indicated at 132. With this arrangement, VACS 48 may be guided into wellbore 34. Drag blocks 130 engage with annular wall 38 creating an axially directed uphole force. The upwardly directed force acts on actuator member 84 causing valve 82 to open. VACS 48 may be operated to remove debris from wellbore 34. Upon completion, letting off downward pressure, such as by tripping tubular string 30 out of wellbore 34, allow spring 113 to bias actuator member 84 in a downward direction causing valve 82 to close. In this manner, VACS 48, in particular the debris collection chamber (not shown) are not exposed to wellbore pressure during withdrawal. At this point, it should be understood that drag blocks 130 and/or springs 132 may be configured to adapt to a wide range of wellbore diameters.

Reference will now follow to FIGS. 6-9 in describing fluid loss valve 56 in accordance with an exemplary aspect. Fluid loss valve 56 maintains a column of fluid above VACS 48 during run in. Maintaining the column of fluid is particularly advantageous in depleted wells. With this arrangement, initiation of VACS 48 may occur once the target depth is reached. Fluid loss valve 56 includes a main body 140 having an inlet portion (box end) 142 and an outlet portion (pin end) 144, an outer surface portion 146 and an inner surface portion 148 that defines an inner chamber 150. A flow passage 151 extends from inlet portion 142 to outlet portion 144.

In an exemplary embodiment, a valve arrangement 154 is arranged in inner chamber 150. Valve arrangement 154 includes a first valve section 157, a second valve section 160, and a spring element 162. Spring element 162 is arranged between first valve section 157 and second valve section 160. Second valve section 160 is coupled to inner surface portion 148 of main body 140 through a shear member 165. Shear member 165 is a frangible coupling designed to fail when exposed to a selected axial force allowing second valve section 160 to shift toward second end 144.

First valve section 157 includes a first end section 168 and a second end section 169. A first plurality of ports 177 is arranged adjacent first end section 168, a second plurality of ports 179 is arranged axially outwardly of first plurality of ports 177, a third plurality of ports 181 is arranged axially outwardly of second plurality of ports 179 and a fourth plurality of ports 183 is arranged axially outwardly of third plurality of ports 161. Fourth plurality of ports 183 is arranged between third plurality of ports 181 and second end section 169. In an embodiment, inner surface portion 148 includes an annular recess 186 and first end section 168 of first valve section 157 includes a ball seat 190.

Figure 6:
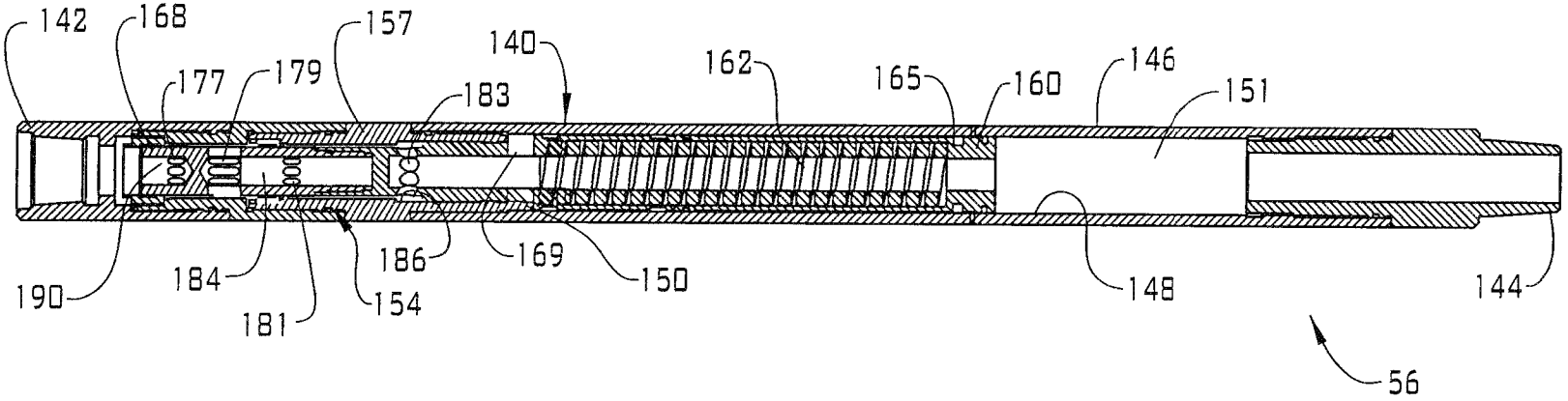
FIG. 6 depicts cross-sectional view a fluid loss valve of the VACS of FIG. 1 shown in a run-in configuration, in accordance with an aspect of an exemplary embodiment.
Figure 7:
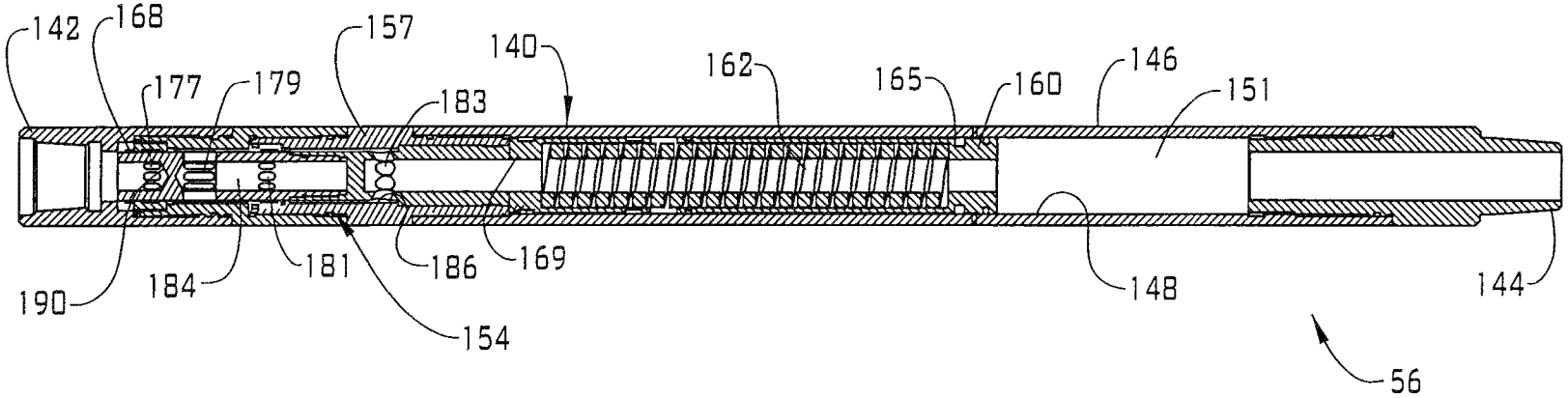
FIG. 7 depicts the depicts cross-sectional view a fluid loss valve of the VACS of FIG. 6 in a clean-out configuration, in accordance with an aspect of an exemplary embodiment.
Figure 8:
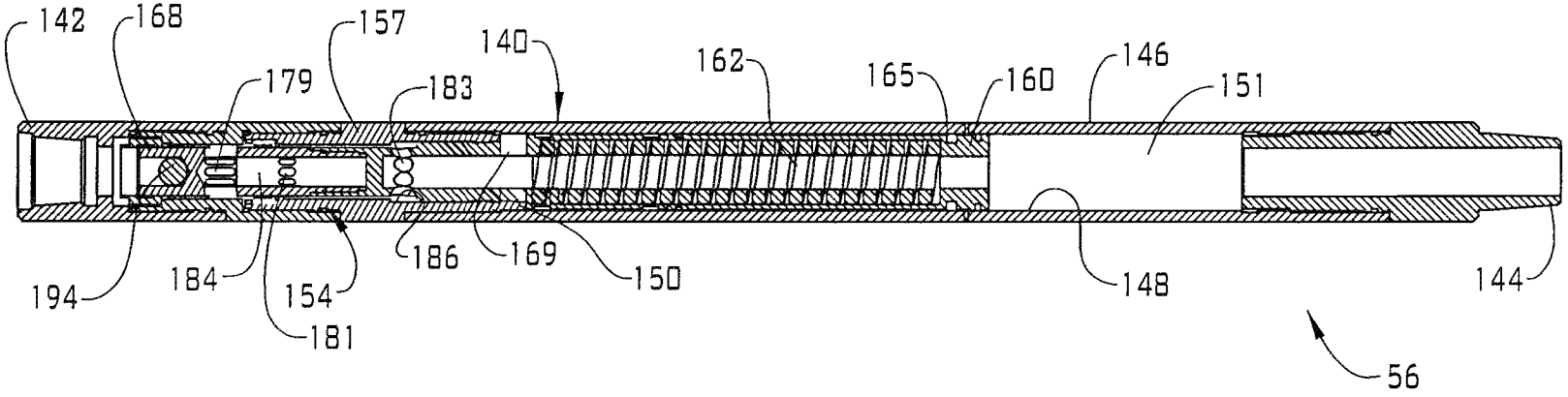
FIG. 8 depicts the cross-sectional view a fluid loss valve of the VACS of FIG. 7, preparing for a run-out, in accordance with an aspect of an exemplary embodiment.
Figure 9:
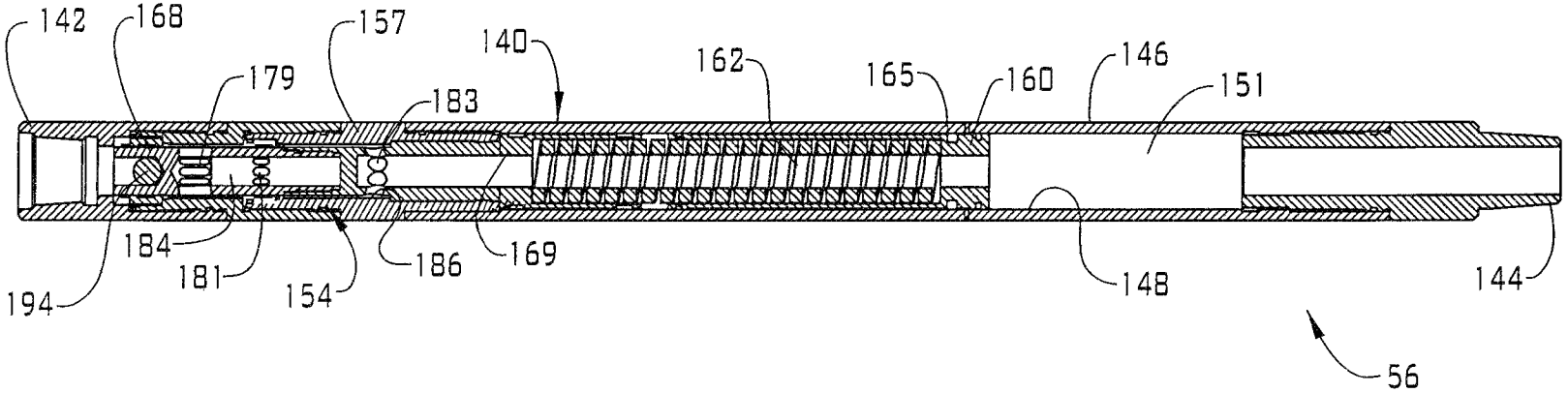
FIG. 9 depicts the cross-sectional view a fluid loss valve of the VACS of FIG. 8 in a run-out configuration, in accordance with an aspect of an exemplary embodiment.

In operation, fluid loss valve 56 is introduced into wellbore 34 in a closed configuration such as shown in FIG. 6. Once at the desired depth, pressure is applied causing first valve section 157 to shift toward inlet portion 142 as shown in FIG. 7 allowing fourth plurality of openings 183 to align with annular recess 186. At this point, fluid may flow into inlet portion 142 through flow passage 151 and exit outlet portion 144 for passage to jet portion 54. Fluid loss valve 56 may be shifted between the position shown in FIG. 6 (closed) and the position shown in FIG. 7 (open) repeatedly as needed. When clean out is completed, a drop ball 194 is introduced into tubular string 30 and run down to ball seat 190 as shown in FIG. 8. Pressure is applied to drop ball 194 causing shear member 165 to fail allowing first valve section 157, second valve section 160 and spring 162 to shift toward outlet portion 144 opening flow passage 151 such that fluid may drain from tubular string 30 prior to run-out.

Reference will now follow to FIGS. 10-13 in describing fluid loss valve 256 in accordance with another exemplary aspect. Fluid loss valve 256 includes a main body 340 having an inlet portion (box end) 342 and an outlet portion (pin end) 344, an outer surface portion 346 and an inner surface portion 348 that defines an inner chamber 350. A flow passage 351 extends from inlet portion 342 to outlet portion 344.

In an exemplary embodiment, a valve arrangement 354 is arranged in inner chamber 350. Valve arrangement 354 includes a first valve section 357 and a second valve section 360. First valve section 357 and second valve section 360 are separated by inner chamber 350. In an embodiment second valve section 360 includes a poppet member 364 including a plurality of ports, one of which is indicated at 366. A spring, 370 is arranged between poppet member 364 and outlet portion 344.

First valve section 357 is coupled to inner surface portion 348 of main body 340 through a shear member (not separately labeled). The shear member is a frangible coupling designed to fail when exposed to a selected axial force allowing first valve section 357 to shift axially toward outlet 344. First valve section 357 includes a first end section 368 and a second end section 369 and a ball seat 372 defined therebetween.

Figure 10:
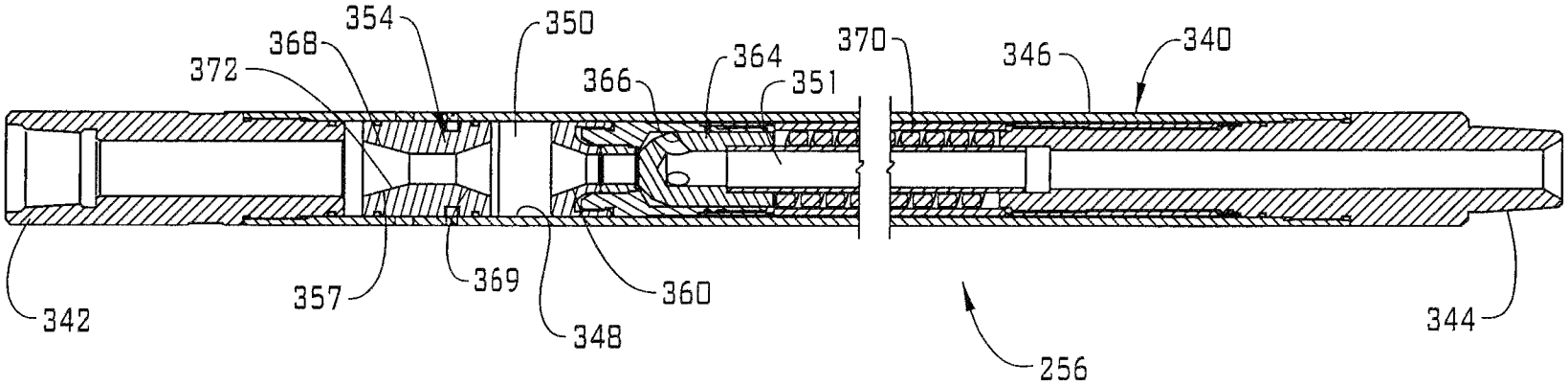
FIG. 10 depicts cross-sectional view a fluid loss valve of the VACS of FIG. 1 shown in a run-in configuration, in accordance with another aspect of an exemplary embodiment.
Figure 11:
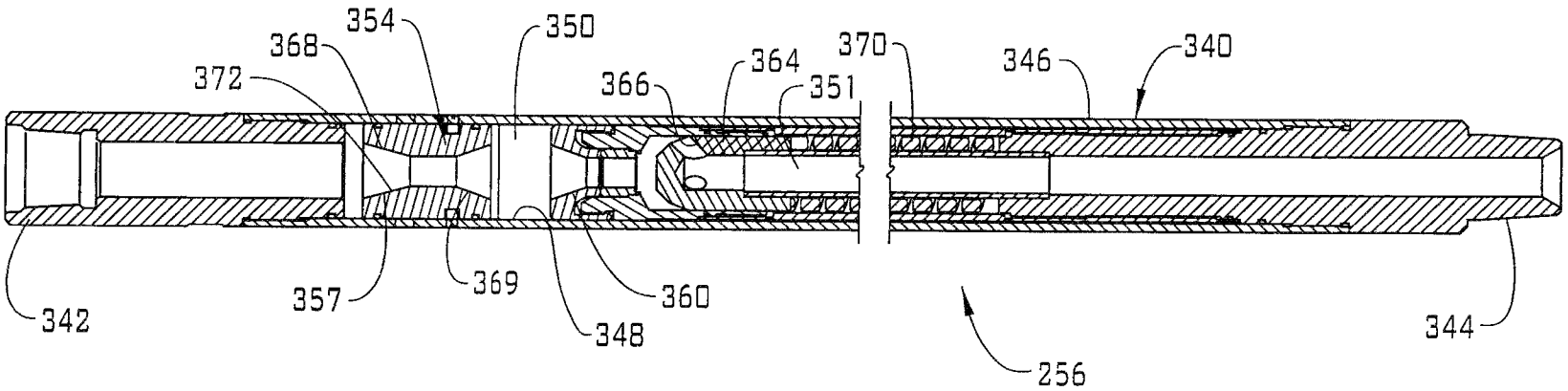
FIG. 11 depicts the depicts cross-sectional view a fluid loss valve of the VACS of FIG. 10 in a clean-out configuration, in accordance with another aspect of an exemplary embodiment.

In operation, fluid loss valve 256 is introduced into wellbore 34 in a closed configuration such as shown in FIG. 10. Once at the desired depth, pressure is applied causing poppet member 364 to move axially against spring 370 and unseat thereby exposing ports 366 as shown in FIG. 11 allowing fluid to flow from inlet 142, into first valve section 357 across inner chamber 350 into second valve section 360. The fluid then passes into flow passage 351 via ports 366 and flows toward outlet portion 344. Fluid loss valve 56 may be shifted between the position shown in FIG. 10 (closed) and the position shown in FIG. 11 (open) repeatedly as needed.

Figure 12:
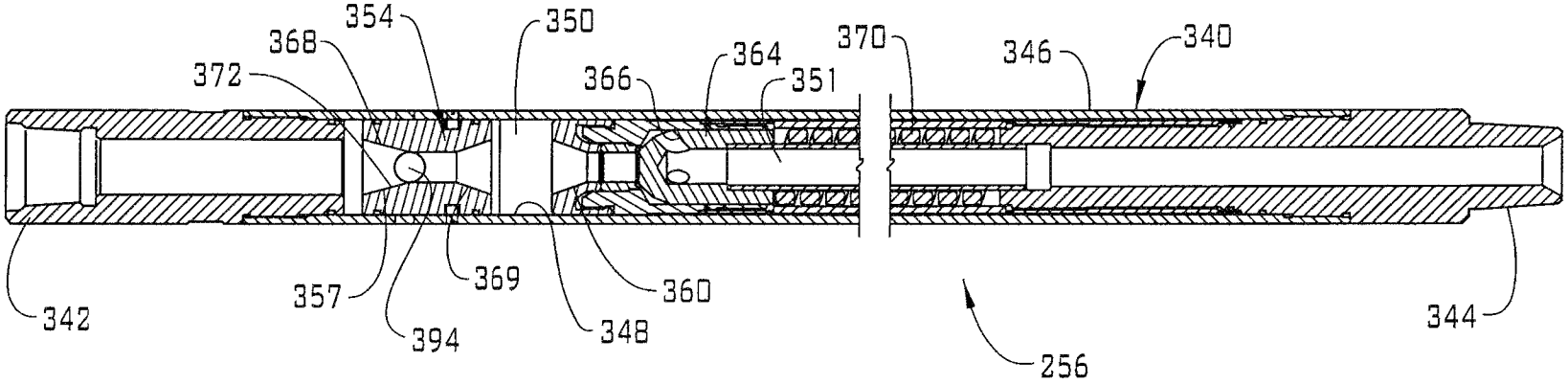
FIG. 12 depicts the cross-sectional view a fluid loss valve of the VACS of FIG. 11, preparing for a run-out, in accordance with another aspect of an exemplary embodiment.
Figure 13:
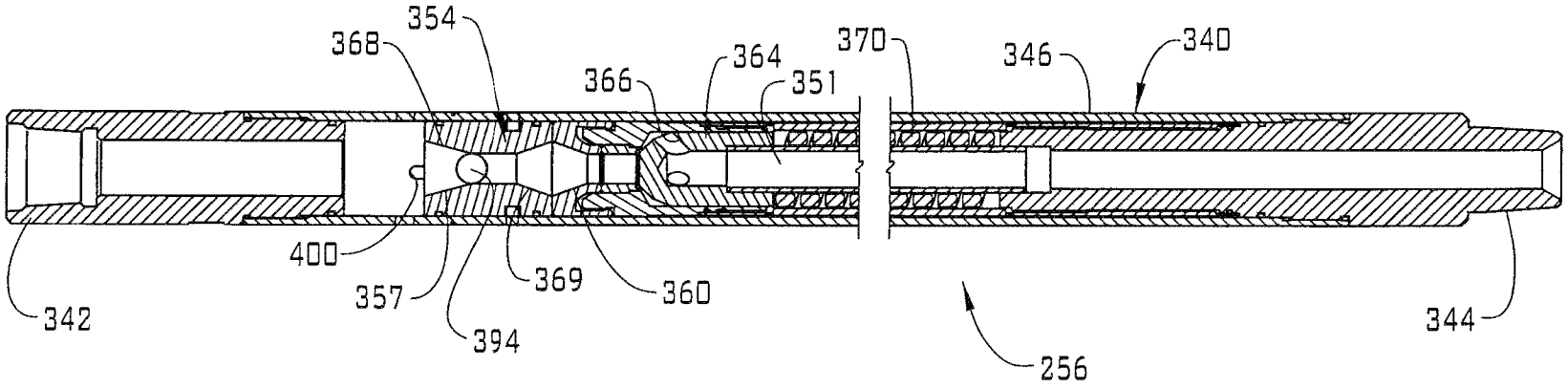
FIG. 13 depicts the cross-sectional view a fluid loss valve of the VACS of FIG. 12 in a run-out configuration, in accordance with another aspect of an exemplary embodiment.

When clean out is completed, a drop ball 394 is introduced into tubular string 30 and run down to ball seat 372 as shown in FIG. 12. Pressure is applied to drop ball 394 causing the shear member 65 to fail allowing first valve section 357 to shift axially across inner chamber 350 to expose an additional outlet port(s) 400 which allows fluid to drain from tubular string 30 prior to run-out.

At this point it should be understood that the exemplary embodiments describe a VACS that may be run-in with a snubber valve an open configuration allowing, for example, a debris collection chamber to be exposed to hydrostatic pressure. After completing a VACS operation, the snubber valve may be closed during run-out such that the debris collection chamber is isolated from hydrostatic pressure.

In an exemplary aspect, the VACS may be provided with a fluid loss valve that maintains an amount of fluid uphole of the jet portion during run-in to, for example, a depleted wellbore. Once in position, the fluid loss valve may be opened to begin the VACS operation. After the VACS operation, the fluid loss valve may be closed and repositioned further downhole without losing fluid from the tubular string. In this manner, the VACS may be paused and repositioned, without losing time, using extra fluid to refill the tubular string, and man-hours waiting to refill the tubular string. Once the VACS operations is completed, the fluid loss valve may be fully opened to allow fluid to drain from the tubular string.

Set forth below are some embodiments of the foregoing disclosure:

Embodiment 1. A vectored annular cleaning system (VACS) comprising: a tool body including a first end, a second end, an outer surface and an inner surface defining an internal bore; a valve system arranged in the internal bore, the valve system including a valve and an actuator member including a central passage, the actuator member extending from the valve toward the second end; and a valve actuator shiftably connected to the tool body and mechanically connected to the actuator member, the valve actuator including a plurality of drag blocks and one or more spring members, the one or more spring members radially outwardly biasing the plurality of drag blocks.

Embodiment 2. The VACS according to any prior embodiment, wherein the actuator member includes a first portion extending from the valve toward the first end, a second portion extending from the valve toward the second end, and a linking member joining the first portion and the second portion, the linking member including a pin element extending radially inwardly into the valve and the valve includes a slot that it receptive of the pin element.

Embodiment 3. The VACS according to any prior embodiment, further comprising: an inlet arranged at the first end of the tool body.

Embodiment 4. The VACS according to any prior embodiment, further comprising: a spring extending about the first portion of the actuator member.

Embodiment 5. The VACS according to any prior embodiment, further comprising: a guide bushing arranged in the internal bore between the valve and the first end, the first portion of the actuator member passing through the guide bushing.

Embodiment 6. The VACS according to any prior embodiment, wherein the spring is arranged between the guide bushing and the inlet.

Embodiment 7. The VACS according to any prior embodiment, wherein the guide bushing comprises a bearing.

Embodiment 8. The VACS according to any prior embodiment, further comprising: a fluid loss valve connected to the inlet, the fluid loss valve including an inlet portion, an outlet portion, and a valve arrangement positioned between the inlet portion and the outlet portion, the valve arrangement selectively fluidically connecting the inlet portion with the tool body.

Embodiment 9. The VACS according to any prior embodiment, wherein the fluid loss valve includes a main body portion including an outer surface portion and an inner surface portion defining a flow passage, a first valve section arranged in the flow passage, a second valve section arranged in flow passage spaced from the first valve section, and a spring arranged between the second valve section and the outlet portion.

Embodiment 10. The VACS according to any prior embodiment, further comprising: a shear member connecting the first valve section to the inner surface.

Embodiment 11. The VACS according to any prior embodiment, wherein the second valve section includes a poppet member supported by the spring.

Embodiment 12. The VACS according to any prior embodiment, wherein the poppet member includes a plurality of ports that is selectively fluidically connected with the outlet portion.

Embodiment 13. The VACS according to any prior embodiment, wherein the first valve section includes a ball seat.

Embodiment 14. A method of removing debris from a wellbore with a vectored annular clean out system (VACS) having a snubber valve comprising: introducing the VACS into the wellbore; creating an axially directed uphole force on the snubber valve; opening the snubber valve with the axially directed uphole force; performing a VACS operation; and picking up the VACS allowing the snubber valve to shift to a closed position.

Embodiment 15. The method according to any prior embodiment, wherein creating the axially directed uphole force includes dragging a plurality of drag blocks along a surface of the wellbore.

Embodiment 16. The method according to any prior embodiment, wherein opening the snubber valve includes rotating a ball valve with the axially directed uphole force.

Embodiment 17. The method according to any prior embodiment, further including maintaining an amount of fluid uphole of the VACS during run-in with a fluid loss valve.

Embodiment 18. The method according to any prior embodiment, further comprising: applying pressure to the amount of fluid to open the fluid loss valve.

Embodiment 19. The method according to any prior embodiment, further comprising: dropping a ball onto the fluid loss valve.

Embodiment 20. The method according to any prior embodiment, further comprising: applying pressure to the ball causing a shear element to fail allowing the fluid loss valve to open and drain the amount of fluid into the wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A vectored annular cleaning system (VACS) comprising:

a tool body including a first end, a second end, an outer surface and an inner surface defining an internal bore;

a valve system arranged in the internal bore, the valve system including a valve and an actuator member including a central passage, the actuator member including a first portion extending from the valve toward the first end, a second portion extending from the valve toward the second end, and a linking member joining the first portion and the second portion, the linking member including a pin element extending radially inwardly into the valve and the valve includes a slot that it receptive of the pin element; and a valve actuator shiftably connected to the tool body and mechanically connected to the actuator member, the valve actuator including a plurality of drag blocks and one or more spring members, the one or more spring members radially outwardly biasing the plurality of drag blocks.

2. The VACS according to claim 1, further comprising: an inlet arranged at the first end of the tool body.

3. The VACS according to claim 2, further comprising: a spring extending about the first portion of the actuator member.

4. The VACS according to claim 3, further comprising: a guide bushing arranged in the internal bore between the valve and the first end, the first portion of the actuator member passing through the guide bushing.

5. The VACS according to claim 4, wherein the spring is arranged between the guide bushing and the inlet.

6. The VACS according to claim 4, wherein the guide bushing comprises a bearing.

7. The VACS according to claim 2, further comprising: a fluid loss valve connected to the inlet, the fluid loss valve including an inlet portion, an outlet portion, and a valve arrangement positioned between the inlet portion and the outlet portion, the valve arrangement selectively fluidically connecting the inlet portion with the tool body.

8. The VACS according to claim 7, wherein the fluid loss valve includes a main body portion including an outer surface portion and an inner surface portion defining a flow passage, a first valve section arranged in the flow passage, a second valve section arranged in flow passage spaced from the first valve section, and a spring arranged between the second valve section and the outlet portion.

9. The VACS according to claim 8, further comprising: a shear member connecting the first valve section to the inner surface.

10. The VACS according to claim 8, wherein the second valve section includes a poppet member supported by the spring.

11. The VACS according to claim 10, wherein the poppet member includes a plurality of ports that is selectively fluidically connected with the outlet portion.

12. The VACS according to claim 10, wherein the first valve section includes a ball seat.

13. A method of removing debris from a wellbore with a vectored annular clean out system (VACS) having a valve as described in claim 1 comprising:

introducing the VACS into the wellbore;

creating an axially directed uphole force on the valve;

opening the valve by moving a pin arranged on a linking member through a slot provided on the valve with the axially directed uphole force;

performing a VACS operation; and picking up the VACS allowing the valve to shift to a closed position.

14. The method of claim 13, wherein creating the axially directed uphole force includes dragging the plurality of drag blocks along a surface of the wellbore.

15. The method of claim 13, wherein opening the valve includes rotating a ball valve with the axially directed uphole force.

16. The method of claim 13, further including maintaining an amount of fluid uphole of the VACS during run-in with a fluid loss valve.

17. The method of claim 16, further comprising: applying pressure to the amount of fluid to open the fluid loss valve.

18. The method of claim 16, further comprising: dropping a ball onto the fluid loss valve.

19. The method of claim 18, further comprising: applying pressure to the ball causing a shear element to fail allowing the fluid loss valve to open and drain the amount of fluid into the wellbore.

* * * * *